US012152584B2

(12) United States Patent
Dong et al.

(10) Patent No.: US 12,152,584 B2
(45) Date of Patent: Nov. 26, 2024

(54) FLANGE AND PUMP BODY ASSEMBLY WITH SAME

(71) Applicant: Gree Electric Appliances, Inc. of Zhuhai, Guangdong (CN)

(72) Inventors: Mingzhu Dong, Guangdong (CN); Yusheng Hu, Guangdong (CN); Huijun Wei, Guangdong (CN); Jia Xu, Guangdong (CN); Liping Ren, Guangdong (CN); Pengkai Wan, Guangdong (CN)

(73) Assignee: Gree Electric Appliances, Inc. of Zhuhai, Guangdong (CN)

( * ) Notice: Subject to any disclaimer, the term of this patent is extended or adjusted under 35 U.S.C. 154(b) by 45 days.

(21) Appl. No.: 17/908,383

(22) PCT Filed: Dec. 24, 2020

(86) PCT No.: PCT/CN2020/139110
§ 371 (c)(1),
(2) Date: Aug. 31, 2022

(87) PCT Pub. No.: WO2022/001033
PCT Pub. Date: Jan. 6, 2022

(65) Prior Publication Data

US 2023/0332600 A1 Oct. 19, 2023

(30) Foreign Application Priority Data

Jun. 29, 2020 (CN) ..... 202010606496.2

(51) Int. Cl.
*F04C 2/344* (2006.01)
*F04C 18/344* (2006.01)

(52) U.S. Cl.
CPC ..... *F04C 18/3441* (2013.01); *F04C 2/3441* (2013.01)

(58) Field of Classification Search
CPC .... F04C 2/3441; F04C 18/3441; F04C 29/12; F04C 2240/30; F04C 2/344; F04C 2/348; F04C 2/3562; F04C 2/356; F04C 2/3564
(Continued)

(56) References Cited

U.S. PATENT DOCUMENTS 2,941,851 A * 6/1960 Bayer ..... F16C 17/10 384/111
3,565,558 A * 2/1971 Tobacman ..... F01C 21/10 418/150
(Continued)

FOREIGN PATENT DOCUMENTS

CN 106704184 A 5/2017
CN 108087270 A 5/2018
(Continued)

OTHER PUBLICATIONS

CN 202010606496.2, First Office Action, Nov. 30, 2023.
CN 202010606496.2, Search Report, Nov. 30, 2023.
JP 2022-552521, Notice of Reasons for Refusal, Sep. 3, 2024.

*Primary Examiner* — Philip E Stimpert
*Assistant Examiner* — Dnyanesh G Kasture
(74) *Attorney, Agent, or Firm* — The Webb Law Firm

(57) ABSTRACT

The present disclosure relates to a flange and a pump body assembly with the same. The flange includes a flange body having a shaft hole formed therein, with a back pressure groove being provided besides the shaft hole, a communication part being provided in a side wall of the back pressure groove on a side close to the shaft hole, the communication part communicating the back pressure groove with the shaft hole, and the communication part being configured to supply lubricating oil to the back pressure groove or discharge the lubricating oil from the back pressure groove. By providing the communication part in the side wall of the back pressure groove of the flange body on the side close to the shaft hole,
(Continued)

the lubricating oil can be timely conveyed into the back pressure groove by means of the communication part.

4 Claims, 10 Drawing Sheets

(58) Field of Classification Search
USPC ..... 418/82; 417/410.3
See application file for complete search history.

(56) References Cited

U.S. PATENT DOCUMENTS

| | | | | |
|---|---|---|---|---|
| 4,571,164 | A | 2/1986 | Shibuya et al. | |
| 7,083,394 | B2 * | 8/2006 | Dalton | F01C 21/0863 418/82 |
| 2020/0149531 | A1 * | 5/2020 | Park | F04C 18/3442 |
| 2021/0207602 | A1 | 7/2021 | Hu et al. | |
| 2021/0239117 | A1 | 8/2021 | Xu et al. | |

FOREIGN PATENT DOCUMENTS

| | | | |
|---|---|---|---|
| CN | 207349076 | U | 5/2018 |
| CN | 207420863 | U | 5/2018 |
| CN | 208010588 | U | 10/2018 |
| CN | 108757454 | A | 11/2018 |
| CN | 108843571 | A | 11/2018 |
| CN | 108930651 | A | 12/2018 |
| CN | 208749550 | U | 4/2019 |
| CN | 210599412 | U | 5/2020 |
| CN | 212337638 | U | 1/2021 |
| JP | 2006194111 | A | 7/2006 |
| JP | 2007192035 | A | 8/2007 |
| JP | 2009257141 | A | 11/2009 |
| JP | 2018105228 | A | 7/2018 |

* cited by examiner

FLANGE AND PUMP BODY ASSEMBLY WITH SAME

CROSS-REFERENCE TO RELATED APPLICATIONS

This disclosure is a U.S. National Stage Application under 35 U.S.C. § 371 of International Patent Application No. PCT/CN2020/139110, filed on Dec. 24, 2020, and claims priority to Chinese Patent Application No. 202010606496.2, filed on Jun. 29, 2020, the disclosures of which are hereby incorporated by reference in their entireties.

BACKGROUND OF THE INVENTION

Field of the Invention

The present disclosure relates to the technical field of pump body equipment, in particular to a flange and a pump body assembly with the same.

Description of Related Art

A sliding vane compressor has the advantages of simple parts, no eccentric structure, a smooth torque and low vibration compared with other types of compressors. A sliding vane therein is pushed out of a sliding vane groove by a centrifugal force or a sliding vane back pressure and thereby abuts against an inner wall of a cylinder to form a seal, so a stable and reliable sliding vane back pressure is an important factor influencing the quality of the sliding vane compressor.

In a rotary vane compressor in the relevant art, to ensure that the sliding vane can smoothly extend out during operation, a back pressure chamber (a sliding vane tail chamber formed by the sliding vane and a sliding vane groove of a main shaft, an upper flange back pressure groove, and a lower flange back pressure groove) is generally provided at the tail of the sliding vane, and a high pressure oil from an oil pool is introduced to provide a motive force to the back of the sliding vane, to overcome gas pressures from chambers in front of and behind the head of the sliding vane and frictions on lateral sides of the sliding vane groove, etc., and achieve that the head of the sliding vane is always in contact with the interior of the cylinder in the whole operation process.

The oil for the back pressure of the sliding vane is mainly pumped by a gear oil pump from the oil pool, and then enters the flange back pressure grooves through a central hole of the main shaft and a side hole of the main shaft connected with the central hole of the main shaft, thereby filling the back pressure chamber.

For a back pressure structure in the relevant art, the oil from the side hole of the main shaft needs to pass through a certain gap before entering, as shown in FIG. 1. According to the law of motion of the sliding vane, the sliding vane performs reciprocating motion in the sliding vane groove at a speed changing periodically. When the sliding vane extends at a fast speed, the volume of the tail chamber of the sliding vane increases rapidly, and the back pressure oil is difficult to replenish in time. Especially during high frequency operation of the compressor, if the oil replenishment is not timely, the sliding vane back pressure decreases, resulting in an insufficient sliding vane back pressure, and thus under the action of gas pressures from the chambers on two sides of the sliding vane, the head of the sliding vane separates from the inner wall of the cylinder, resulting in leakage, which affects the performance of the compressor, and the sliding vane collides with the inner wall of the cylinder when extending out again, which affects the reliability of the compressor. Furthermore, when the sliding vane retracts at a fast speed, oil in the sliding vane tail chamber cannot be timely discharged, such that the back pressure is too high, the friction between the head of the sliding vane and inner wall of the cylinder increases, and power consumption increases, thereby affecting the energy efficiency and reliability of the compressor.

SUMMARY OF THE INVENTION

According to one aspect of embodiments of the present disclosure, a flange is provided, which includes a flange body having a shaft hole formed therein, with a back pressure groove being provided besides the shaft hole, a communication part being provided in a side wall of the back pressure groove on a side close to the shaft hole, the communication part communicating the back pressure groove with the shaft hole, and the communication part being configured to supply lubricating oil to the back pressure groove or discharge the lubricating oil from the back pressure groove.

In some embodiments, the communication part includes a notch provided in the side wall of the back pressure groove, and/or the communication part includes a through hole structure provided in the side wall of the back pressure groove.

In some embodiments, a plurality of communication parts are provided, the plurality of communication parts being arranged circumferentially of the shaft hole in a spaced manner.

In some embodiments, the communication part includes a first notch, and the back pressure groove has a first position on the side wall on the side close to the shaft hole, the first notch being formed at the first position, and an included angle $\alpha 1$ being formed by connecting lines between two ends of the first notch and the center of the shaft hole, wherein $A-50' \leq \alpha 1 \leq A+50°$, A being an angle of rotation when a sliding vane begins to extend from a first initial position out of a sliding vane groove until a speed of the sliding vane reaches its maximum.

In some embodiments, the communication part further includes a second notch, the second notch being arranged to be spaced from the first notch, and the back pressure groove has a second position on the side wall on the side close to the shaft hole, the second notch being formed at the second position, and an included angle $\alpha 2$ being formed by connecting lines between two ends of the second notch and the center of the shaft hole, wherein $B-50' \leq \alpha 2 \leq B+50°$, B being an angle of rotation when the sliding vane begins to retract from a second initial position toward the sliding vane groove until the speed of the sliding vane reaches its maximum.

In some embodiments, the communication part is configured in an arc shape, and an included angle $\theta$ is formed by connecting lines between two ends of the communication part and the center of the shaft hole, wherein $A-50° \leq \theta \leq B+50°$, or $A-30° \leq \theta \leq B+30°$, A being an angle of rotation when a sliding vane begins to extend out of a sliding vane groove until a speed of the sliding vane reaches its maximum, and B being an angle of rotation when the sliding vane begins to retract toward the sliding vane groove until the speed of the sliding vane reaches its maximum.

In some embodiments, the communication part is a notch formed in the side wall of the back pressure groove, a height difference between the notch and the flange plane being H1, a depth of the back pressure groove being H2, and a thickness of the flange body being H, wherein a ratio of H2 to H is in a range of 0.1-0.6, and a ratio of H1 to H2 is in a range of 0.1-1.

In some embodiments, H1≥1 mm.

In another aspect of embodiments of the present disclosure, a pump body assembly is provided, which includes a flange in an embodiment described above.

In some embodiments, the pump body assembly further includes a cylinder, the flange body being located on a side of the cylinder; and a main shaft having a central part, with at least one of the at least one sliding vane groove being formed in the central part, a sliding vane being provided in each sliding vane groove, the main shaft being passed through the shaft hole, and the central part being located in the cylinder, the main shaft configured to drive the sliding vane to rotate so as to perform compression operation in the cylinder.

In some embodiments, by providing the communication part in the side wall of the back pressure groove of the flange body on the side close to the shaft hole, the lubricating oil can be timely conveyed into the back pressure groove by means of the communication part, thus avoiding the problem of unsmooth oil supply due to supplying oil by means of a gap formed between a flange and a main shaft in the relevant art. By using the flange with the structure, the lubricating oil can smoothly enter the back pressure groove, such that a stable and reliable oil pressure can be provided at the tail of the sliding vane at each angle where the sliding vane extends, and stable operation can be maintained even at the maximum extending and retracting speeds, thus effectively improving the stability and reliability of a pump body assembly with the flange.

BRIEF DESCRIPTION OF THE DRAWINGS

Drawings illustrated herein are used for providing further understanding of the present disclosure and form part of the present disclosure, and illustrative embodiments of the present disclosure and description thereof are intended for explaining instead of improperly limiting the present disclosure. In the drawings.

DESCRIPTION OF THE INVENTION

Figure 1:
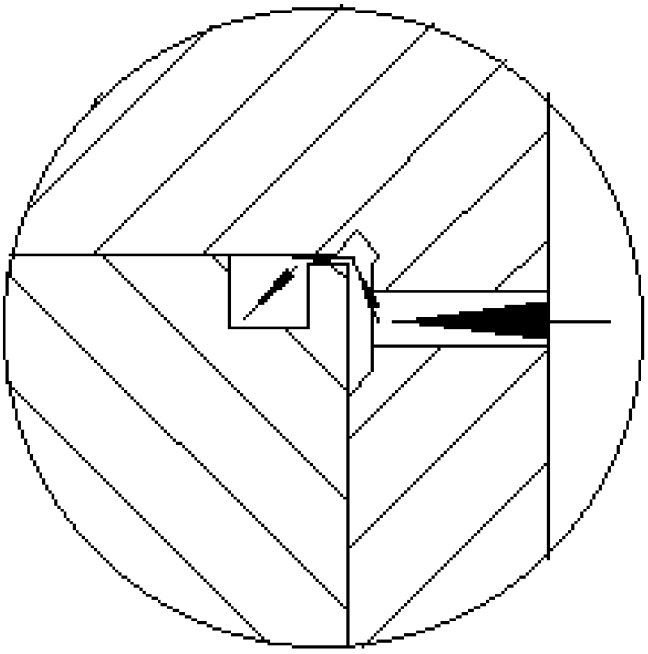
FIG. 1 shows a schematic diagram of lubricating oil supply by means of a gap between a flange and a main shaft in the relevant art.

The technical solutions in the embodiments will be described clearly and completely below in conjunction with the accompanying drawings in the embodiments of the present disclosure. Obviously, the described embodiments are only a part of the embodiments of the present disclosure, and not all the embodiments. Based on the embodiments in the present disclosure, all other embodiments obtained by those of ordinary skill in the art without creative work should fall into the protection scope of the present disclosure.

In description of the present disclosure, it needs to be appreciated that orientation or position relations denoted by the terms "center", "longitudinal", "transverse", "front", "rear", "left", "right", "vertical", "horizontal", "top", "bottom", "inner", "outer" and the like are orientation or position relations illustrated based on the drawings, are merely for the convenience of describing the present disclosure and simplifying description, instead of indicating or implying the denoted devices or elements must have specific orientations or be constructed and operated in specific orientations, and thus the terms cannot be construed as limiting the protection scope of the present disclosure.

Some embodiments of the present disclosure provide a flange and a pump body assembly with the same to alleviate the problem of unsmooth oil supply to a sliding vane back pressure chamber in the related art.

As shown in FIGS. 2 to 10, according to some embodiments of the present disclosure, a flange is provided.

The flange includes a flange body 10. The flange body 10 has a shaft hole 11 formed therein. On a side of the shaft hole 11, a back pressure groove 12 is provided around the shaft hole 11. A communication part 13 is provided in a side wall of the back pressure groove 12 on a side close to the shaft hole 11. The communication part 13 communicates the back pressure groove 12 with the shaft hole 11, and the communication part 13 is configured to supply lubricating oil to the back pressure groove 12 or discharge the lubricating oil from the back pressure groove 12.

In this embodiment, by providing the communication part 13 in the side wall of the back pressure groove 12 of the flange body 10 on the side close to the shaft hole 11, the lubricating oil can be timely conveyed into the back pressure groove 12 by means of the communication part 13, thus avoiding the problem of unsmooth oil supply due to supplying oil by means of a gap formed between a flange and a main shaft in the relevant art. By using the flange with the structure, the lubricating oil can smoothly enter the back pressure groove 12, such that a stable and reliable oil pressure can be provided at the tail of a sliding vane at each angle where the sliding vane extends, and stable operation can be maintained even at maximum extending and retracting speeds of the sliding vane, thus effectively improving the stability and reliability of a pump body assembly with the flange.

The communication part 13 may be a notch formed in the side wall of the back pressure groove 12. Alternatively, the communication part 13 may also be a through hole formed in the side wall of the back pressure groove 12; of course, it is also possible to form both a notch and a through hole in the side wall of the back pressure groove 12, as needed.

Figure 2:
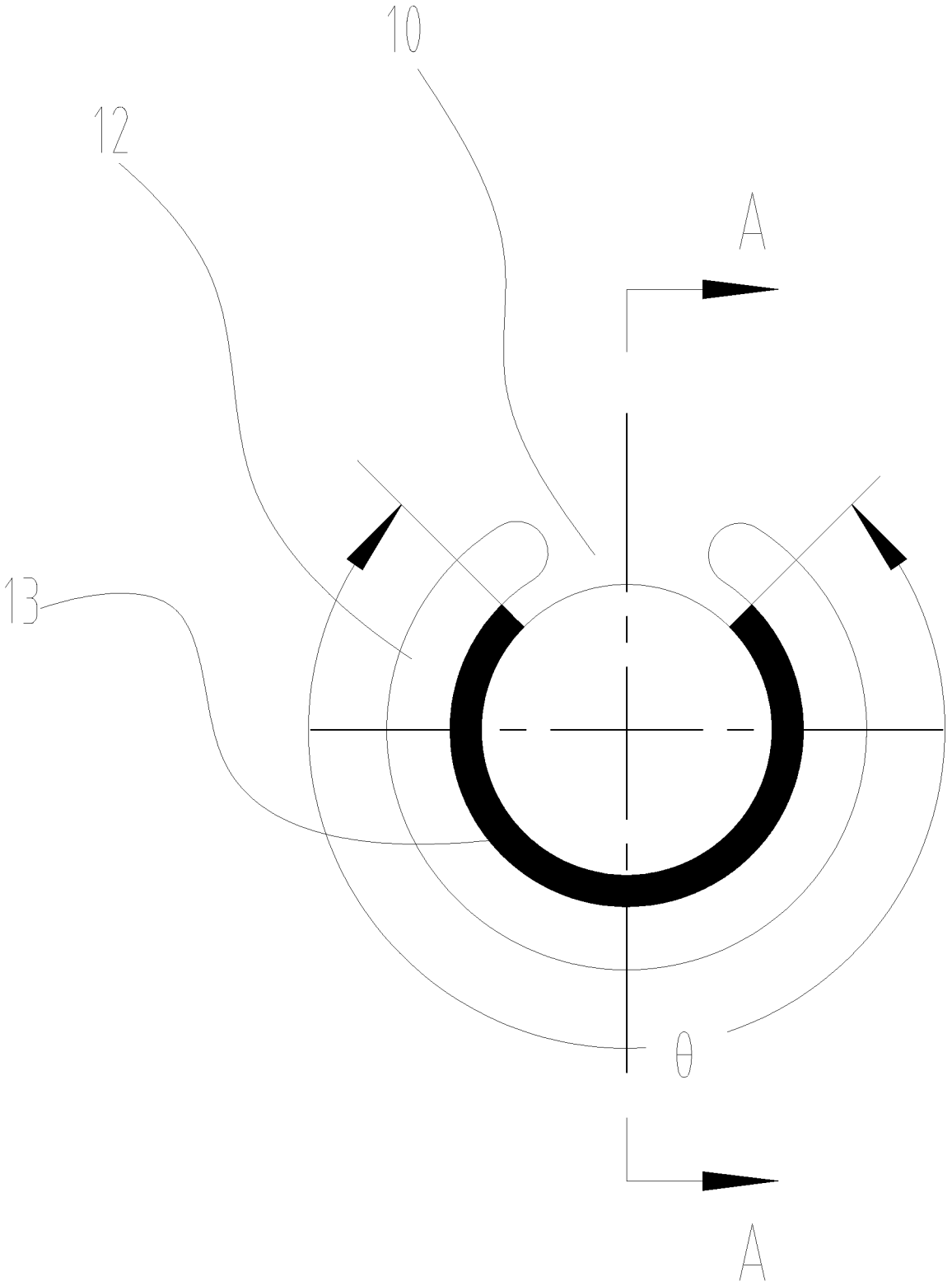
FIG. 2 shows a structural diagram of a first embodiment of a flange according to the present disclosure.
Figure 3:
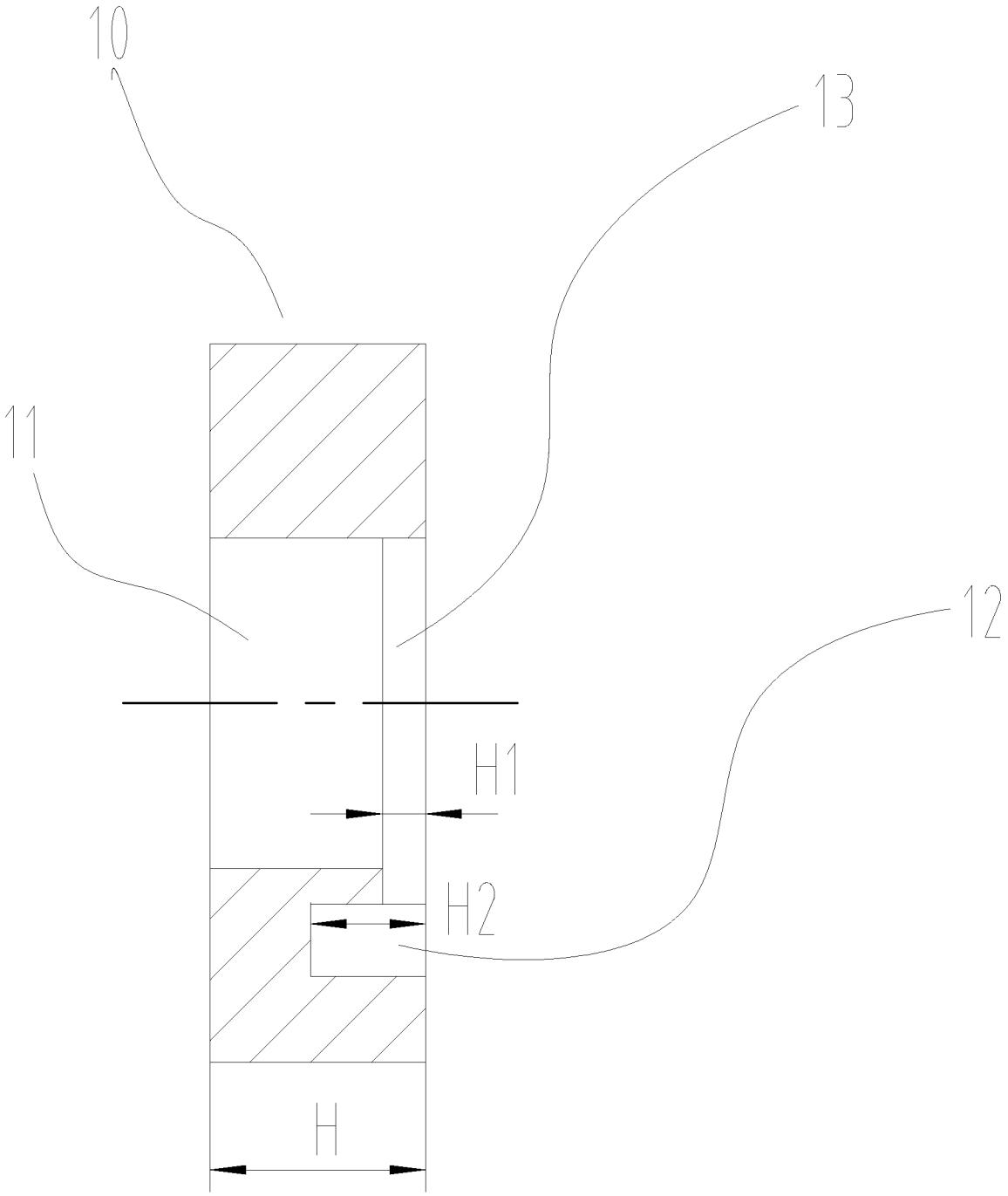
FIG. 3 shows a sectional structural diagram of FIG. 2 at A-A.

In some embodiments, as shown in FIGS. 2 and 3, the communication part 13 is a notch formed in the side wall of the back pressure groove 12. Such configuration facilitates processing.

In some embodiments, a plurality of communication parts 13 may be provided, the plurality of communication parts 13 being arranged circumferentially of the shaft hole 11 in a spaced manner. With such configuration, the positions of corresponding communication parts can be set according to a movement state of the sliding vane, so that in compression operation, the entire pump body assembly can ensure that the sliding vane is always in a stable compression state under the action of the back pressure groove, thus improving the reliability of the pump body assembly with the flange. As shown in FIGS. 2 to 5, the communication part 13 is a notch structure, formed in the side wall, with one notch.

Figure 6:
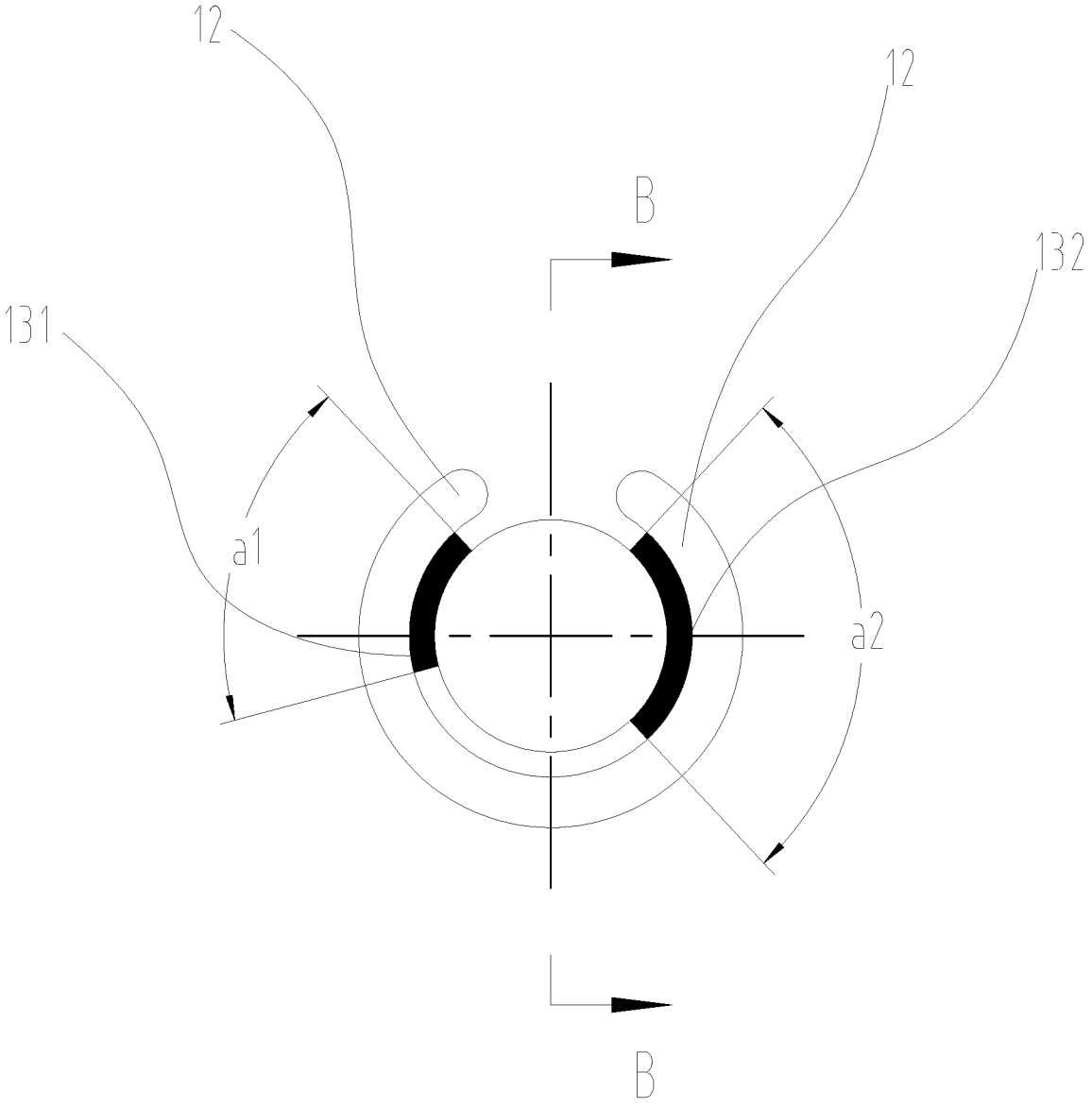
FIG. 6 shows a structural diagram of a fourth embodiment of the flange according to the present disclosure.
Figure 7:
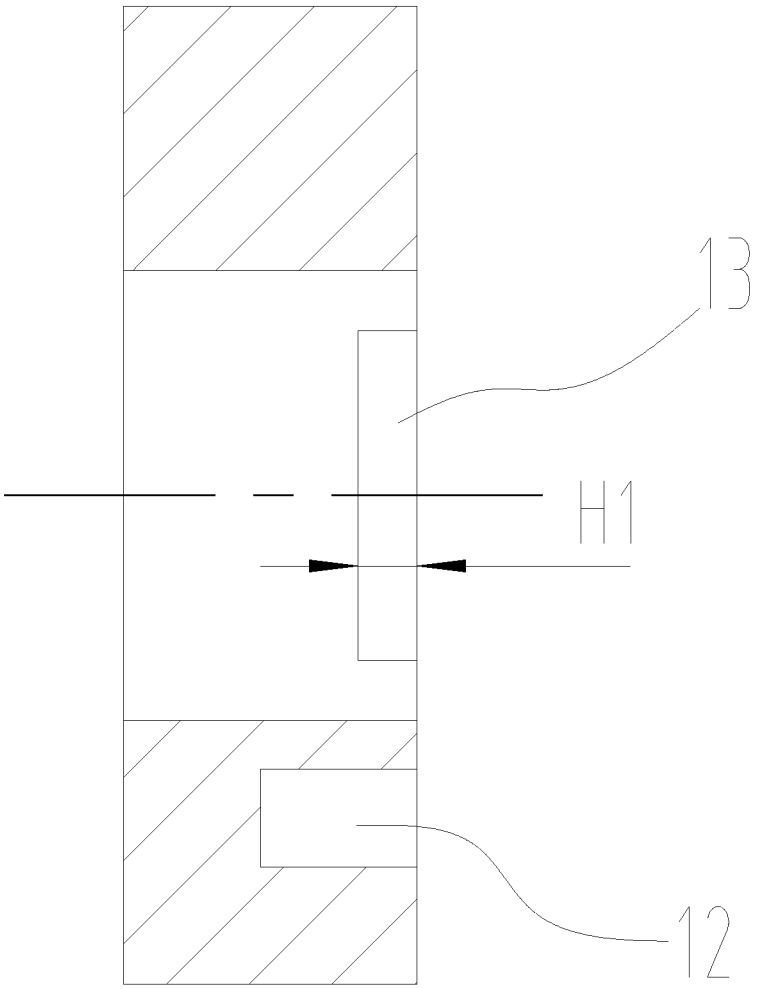
FIG. 7 shows a sectional structural diagram of FIG. 6 at B-B.
Figure 8:
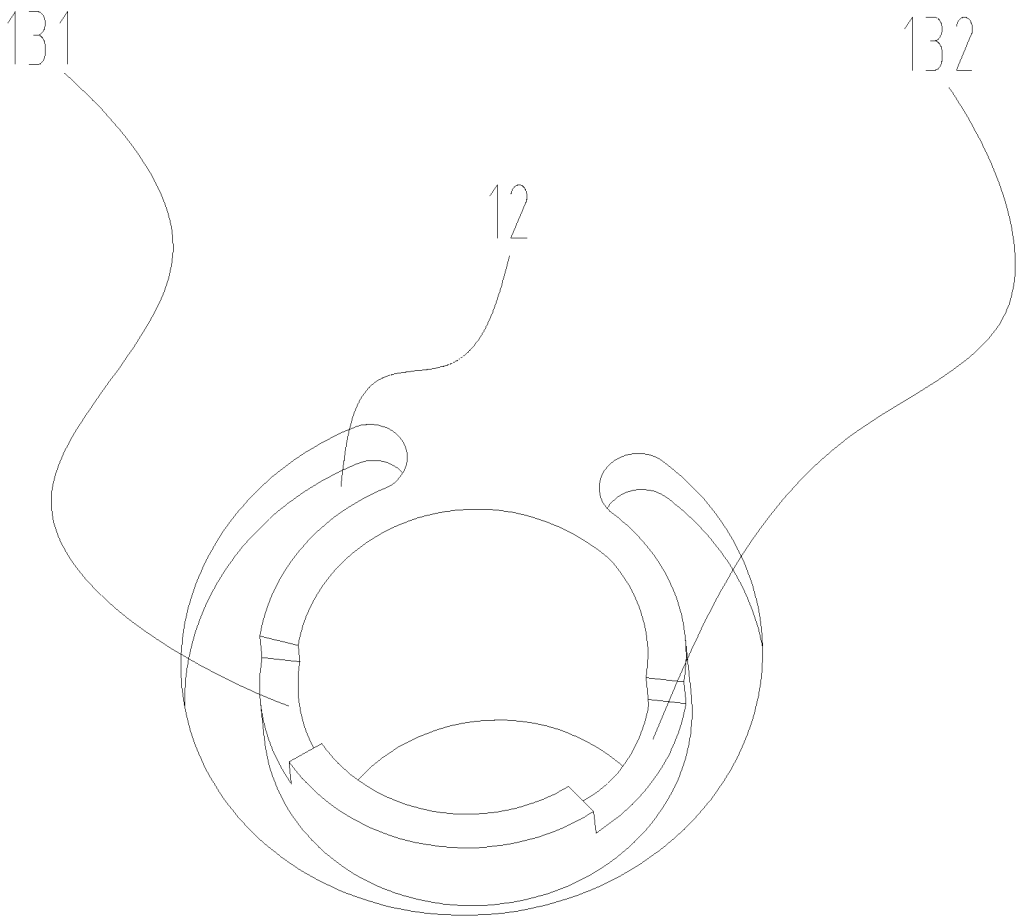
FIG. 8 shows a structural diagram of a fifth embodiment of the flange according to the present disclosure.
Figure 11:
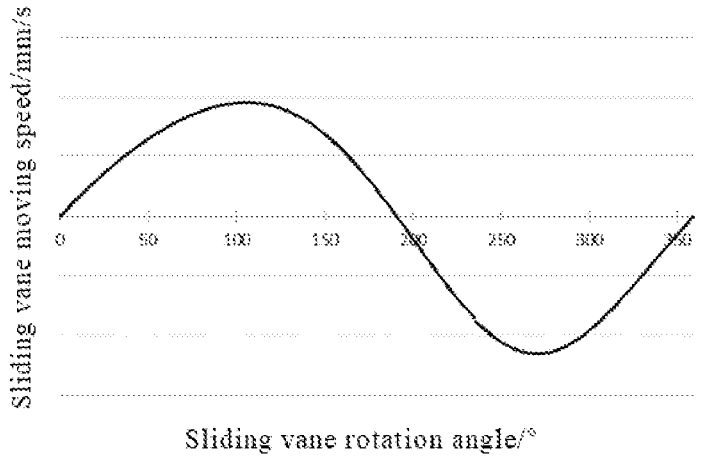
FIG. 11 shows a schematic diagram of a relationship between a moving speed and a rotation angle of a sliding vane provided according to some embodiments of the present disclosure.

As shown in FIGS. 6 to 8, the communication part 13 includes a first notch 131, and the back pressure groove 12 has a first position on the side wall on the side close to the shaft hole 11, the first notch 131 being formed at the first position, and an included angle $\alpha 1$ being formed by connecting lines between two ends of the first notch 131 and the center of the shaft hole 11, wherein $A-50° \leq \alpha 1 \leq A+50°$, A being a rotation angle of the sliding vane rotates with a main shaft of the pump body assembly when the sliding vane extends from a first initial position (i.e. a position where a working chamber of the sliding vane starts air intake) out of a sliding vane groove until the speed of the sliding vane reaches its maximum, wherein the maximum speed of the sliding vane extending from the sliding vane groove can be obtained by mathematical calculations according to the sizes of the rotating shaft, the sliding vane, a cylinder, etc., as shown in FIG. 11, which illustrates an embodiment in which the angle of rotation is 105° when the speed of the sliding vane extending along the sliding vane groove reaches its maximum. A sliding vane moving speed in FIG. 11 includes a speed at which the sliding vane extends out of the sliding vane groove and a speed at which the sliding vane retracts into the sliding vane groove.

The communication part 13 further includes a second notch 132, the second notch 132 being arranged to be spaced from the first notch 131, and the back pressure groove 12 has a second position on the side wall on the side close to the shaft hole 11, the second notch 132 being formed at the second position, and an included angle $\alpha 2$ being formed by connecting lines between two ends of the second notch 132 and the center of the shaft hole 11, wherein $B-50° \leq \alpha 2 \leq B+50°$, B being a rotation angle of the sliding vane rotates with the main shaft of the pump body assembly when the sliding vane retracts from a second initial position (in an intake and compression cycle of the working chamber, the sliding vane starts extending out, and after extending a preset value, the sliding vane gradually retracts into the sliding vane groove; the second initial position is a position where the sliding vane starts implementing retract into the sliding vane groove) toward the sliding vane groove until the retracting speed of the sliding vane reaches its maximum, wherein similarly, the maximum speed of the sliding vane retracting into the sliding vane groove can also be obtained by mathematical calculations according to the sizes of the rotating shaft, the sliding vane, the cylinder, etc. With such configuration, a stable and reliable oil pressure can be provided at the tail of the sliding vane at each position where the sliding vane extends, and stable operation can be maintained even when the sliding vane extends out of the sliding vane groove at the maximum speed and when the sliding vane retracts toward the sliding vane groove at etc. the maximum speed.

Figure 4:
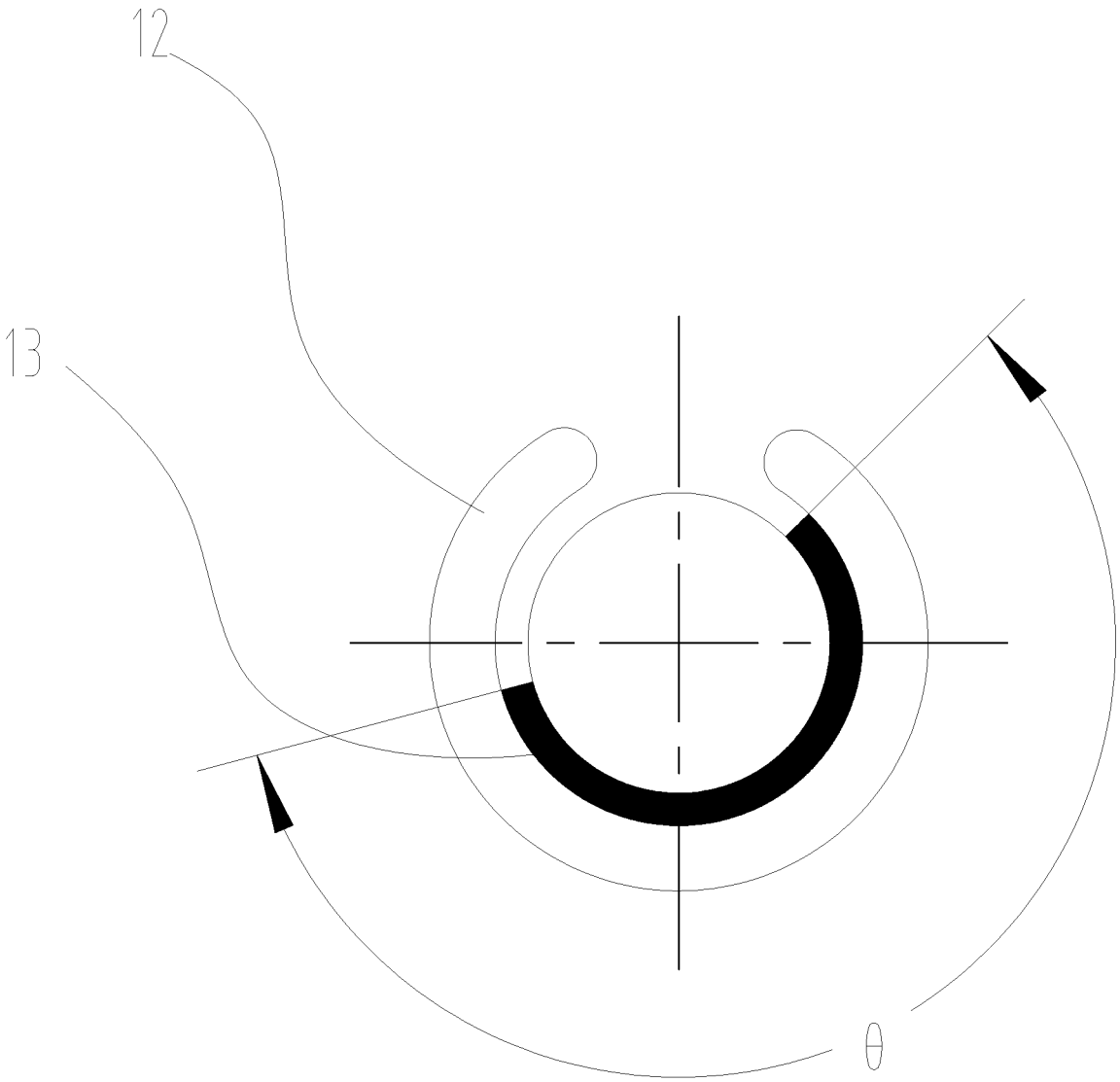
FIG. 4 shows a structural diagram of a second embodiment of the flange according to the present disclosure.
Figure 5:
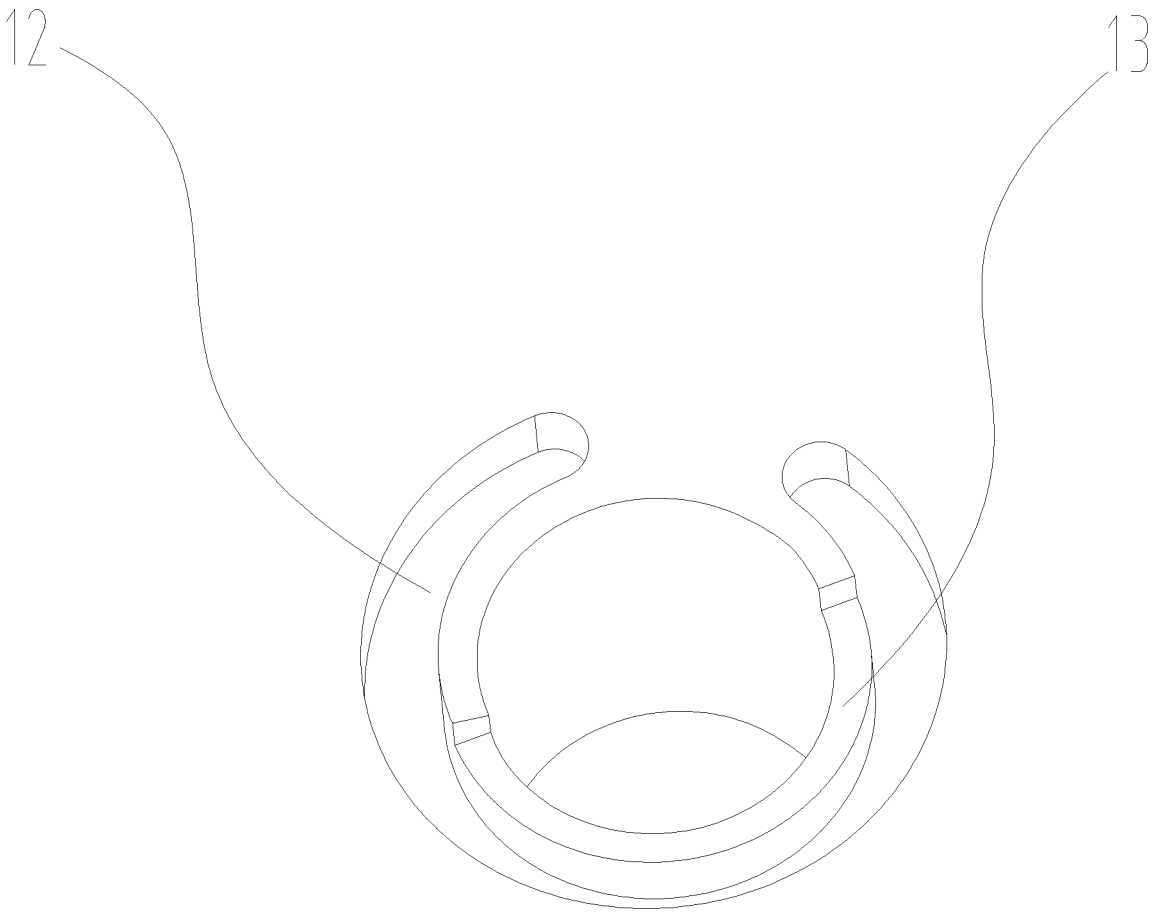
FIG. 5 shows a structural diagram of a third embodiment of the flange according to the present disclosure.

In some embodiments, the communication part 13 is configured in an arc shape around the shaft hole 11, and an included angle $\theta$ is formed by connecting lines between two ends of the communication part 13 and the center of the shaft hole 11, wherein $A-50° \leq \theta \leq B+50°$, or $A-30° \leq \theta \leq B+30°$. As shown in FIGS. 2 and 4, the communication part 13 is a notch structure, with an included angle $\theta$ being formed by connecting lines between two ends of a notch and the center of the shaft hole 11, wherein $A-50° \leq \theta \leq B+50°$, or $A-30° \leq \theta \leq B+30°$. A is a rotation angle of the sliding vane rotates with the main shaft of the pump body assembly when the sliding vane starts to extend out of the sliding vane groove until the speed of the sliding vane reaches its maximum; and B is a rotation angle of the sliding vane rotates with the main shaft of the pump body assembly when the sliding vane starts to retract toward the sliding vane groove until the speed of the sliding vane reaches its maximum.

As shown in FIG. 3, the communication part 13 is a notch formed in the side wall of the back pressure groove 12, a height difference between the notch and the flange plane being H1, the depth of the back pressure groove 12 being H2, and the thickness of the flange body 10 being H, wherein a ratio of H2 to H is in a range of 0.1-0.6, and a ratio of H1 to H2 is in a range of 0.1-1, and $H1 \geq 1$ mm. Such configuration can ensure the timeliness of oil supply to and discharge from the back pressure groove 12, while reducing the resistance to lubricating oil flow at the notch.

In some embodiments, the flange may be used in a pump body equipment assembly. That is, according to another aspect of some embodiments of the present disclosure, there is provided a pump body assembly including a flange, which is the flange in an embodiment described above.

In some embodiments, the pump assembly includes a cylinder 20 and a main shaft 30. The flange body 10 is located on a side of the cylinder 20. The main shaft 30 has a central part 31, with at least one sliding vane groove being formed in the central part 31, a sliding vane 40 being provided in each of the at least one sliding vane groove, the main shaft 30 being passed through the shaft hole 11, and the central part 31 being located in the cylinder 20, the main shaft 30 driving the sliding vane 40 to rotate so as to perform compression operation in the cylinder 20. A back pressure chamber is formed at the back pressure groove 12 of the flange body 10.

Figure 10:
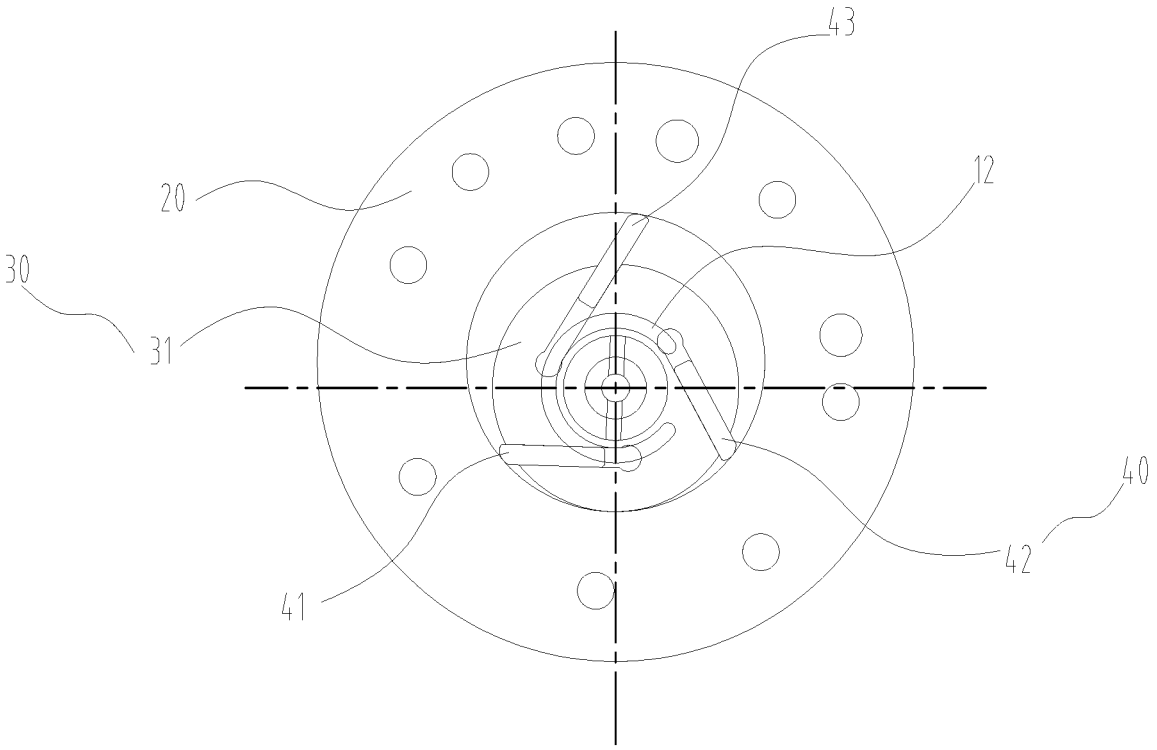
FIG. 10 shows a structural diagram of a pump body assembly provided according to some embodiments of the present disclosure.

In some embodiments, as shown in FIG. 10, three sliding vane grooves are formed in the central part 31, and a first sliding vane 41, a second sliding vane 42, and a third sliding vane 43 are respectively provided in the three sliding vane grooves. The above-mentioned first initial position is a position where the first sliding vane 41 is located in FIG. 10, at which time the first sliding vane 41 completes compression operation and starts to extend from the sliding vane groove for the next cycle of compression operation. The second initial position is a position where the third sliding vane 43 extends to its farthest position and starts to retract toward the sliding vane groove.

Figure 9:
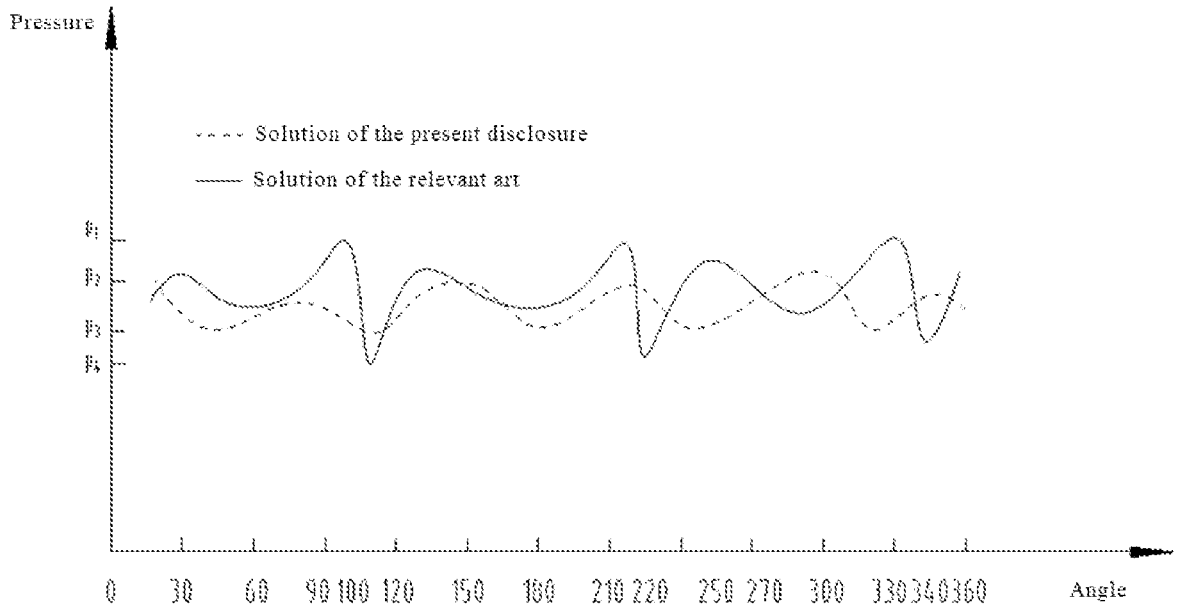
FIG. 9 shows a comparison diagram of a pressure in a back pressure groove formed on the flange provided according to some embodiments of the present disclosure and a pressure in a back pressure groove formed on a flange in the relevant art.

As shown in FIG. 9, it can be seen that in a back pressure groove solution provided by embodiments of the present disclosure, a pressure change range P2-P3 throughout a rotation cycle is smaller than P1-P4, indicating that pressure changes of the back pressure groove provided by the embodiments of the present disclosure are relatively smooth with small fluctuations, wherein at the positions of the maximum extending speed and the maximum retracting speed of the sliding vane, the pressure of the back pressure groove provided by the embodiments of the present disclosure is greater than that of a back pressure groove in the related art, and can better support the tail of the sliding vane steadily.

In the description of the present disclosure, it needs to be appreciated that the use of the terms "first", "second", "third" and the like to define parts and components is only for the convenience of distinguishing the above-mentioned parts and components. Unless otherwise stated, the above terms have no special meanings, and therefore cannot be construed as limitations on the protection scope of the present disclosure.

In addition, technical features of one embodiment may be beneficially combined with one or more other embodiments, unless explicitly denied.

Finally, it should be noted that the above embodiments are only used for describing rather than limiting the technical solutions of the present disclosure. Although the present disclosure is described in detail with reference to the preferred embodiments, those of ordinary skill in the art should understand that they still can make modifications to the specific implementations in the present disclosure or make equivalent substitutions to part of technical features thereof; and such modifications and equivalent substitutions should be encompassed within the scope of the technical solutions sought for protection in the present disclosure so long as they do not depart from the spirit of the technical solutions of the present disclosure.

The invention claimed is:

1. A pump body assembly, comprising:

a cylinder, a flange body being located on a side of the cylinder, a main shaft having a central part, with a plurality of sliding vane grooves being formed in the central part, a sliding vane being provided in each of the plurality of sliding vane grooves, the main shaft being passed through a shaft hole, and the central part being located in the cylinder, the main shaft configured to drive the sliding vanes to rotate so as to perform compression operation in the cylinder, and a flange, comprising:

a flange body provided with a shaft hole, a back pressure groove being provided beside the shaft hole, a communication part being provided on a side wall between the shaft hole and the back pressure groove, the communication part communicating the back pressure groove with the shaft hole, and the communication part being configured to supply lubricating oil to the back pressure groove or discharge the lubricating oil from the back pressure groove, wherein the communication part comprises a first notch located on the side wall between the shaft hole and the back pressure groove, and an included angle $\alpha 1$ being formed by connecting lines between two ends of the first notch and a center of the shaft hole is equal to A, A being an angle of rotation of the shaft from a first rotational position when a sliding vane begins to extend from a first retracted position out of a sliding vane groove to a second rotational position when a speed of the sliding vane reaches its maximum, wherein the sliding vane has a phase of extension from the sliding vane groove beginning with a zero speed position and ending with a maximum extension speed position, wherein the first notch has a circumferential extent from a first position on the side wall in radial alignment with the zero speed beginning position of the sliding vane's extension phase to a second position on the side wall in radial alignment with the maximum extension speed position of the sliding vane's extension phase, wherein the communication part further comprises a second notch located on the side wall between the shaft hole and the back pressure groove, and an included angle $\alpha 2$ being formed by connecting lines between two ends of the second notch and the center of the shaft hole is equal to B, B being an angle of rotation of the shaft from a third rotational position when the sliding vane begins to retract from a second fully extended position toward the sliding vane groove to a fourth rotational position when the speed of the sliding vane reaches its maximum, wherein the sliding vane has a phase of retraction back into the sliding vane groove beginning with a zero speed position and ending with a maximum retraction speed position, wherein the second notch has a circumferential extent from a first position on the side wall in radial alignment with the zero speed beginning position of the of the sliding vane's retraction phase to a second position on the side wall in radial alignment with the maximum retraction speed position of the sliding vane's retraction phase.

2. The pump body assembly according to claim 1, wherein there are a plurality of communication parts in addition to said communication part, the plurality of communication parts being arranged circumferentially around the shaft hole in a spaced manner.

3. The pump body assembly according to claim 1, wherein a height, difference between the notch and a flange plane being H1, a depth of the back pressure groove being H2, and a thickness of the flange body being H, wherein a ratio of H2 to H is in a range of 0.1-0.6, and a ratio of H1 to H2 is in a range of 0.1-1.

4. The pump body assembly according to claim 3, wherein $H1 \geq 1$ mm.

* * * * *